US009752855B2

(12) United States Patent
Medwell et al.

(10) Patent No.: US 9,752,855 B2
(45) Date of Patent: Sep. 5, 2017

(54) COMBINED VEHICULAR ARMOUR

(75) Inventors: Roger T. A. Medwell, Coventry (GB); Christopher Davies, Coventry (GB)

(73) Assignee: NP Aerospace Limited, Coventry (GB)

( * ) Notice: Subject to any disclaimer, the term of this patent is extended or adjusted under 35 U.S.C. 154(b) by 1548 days.

(21) Appl. No.: 12/460,910

(22) Filed: Oct. 16, 2009

(65) Prior Publication Data

US 2015/0143984 A1 May 28, 2015

(30) Foreign Application Priority Data

Nov. 25, 2008 (GB) ..... 0821698.8

(51) Int. Cl.
*F41H 7/04* (2006.01)
*F41H 5/04* (2006.01)
*F41H 7/00* (2006.01)

(52) U.S. Cl.
CPC ..... *F41H 5/0428* (2013.01); *F41H 5/0414* (2013.01); *F41H 7/00* (2013.01); *F41H 7/04* (2013.01)

(58) Field of Classification Search
CPC ... F41H 7/02; F41H 7/04; F41H 7/044; F41H 7/046; F41H 7/048; F41H 5/20
USPC ..... 89/36.08
See application file for complete search history.

(56) References Cited

U.S. PATENT DOCUMENTS

| | | | | |
|---|---|---|---|---|
| 3,431,818 | A * | 3/1969 | King | 89/36.02 |
| 5,738,925 | A * | 4/1998 | Chaput | 89/36.02 |
| 6,532,857 | B1 * | 3/2003 | Shih et al. | 89/36.02 |
| 2005/0066805 | A1 * | 3/2005 | Park et al. | 89/36.02 |

FOREIGN PATENT DOCUMENTS

| | | |
|---|---|---|
| GB | 2364956 | 2/2002 |
| WO | WO03010484 | 2/2003 |

* cited by examiner

*Primary Examiner* — Stephen M Johnson
(74) *Attorney, Agent, or Firm* — Kilpatrick Townsend & Stockton LLP; Dean W. Russell

(57) ABSTRACT

Vehicle armor comprises a ceramic panel (1) with a spall covering (6) on a front surface thereof, a rear surface of the ceramic panel being bonded to a stiff support plate (3). A plastically deformable layer (9) is arranged behind the support plate and contiguous therewith. Spacer means define a substantially planar space (14) arranged to be located between the plastically deformable layer (9) and a vehicle hull (13). There may be a frontal plate comprising a ceramic layer (3) bonded between two layers (4, 5) of high strength carbon or glass.

16 Claims, 3 Drawing Sheets

COMBINED VEHICULAR ARMOUR

FIELD OF THE INVENTION

This invention relates to armour for a vehicle.

BACKGROUND OF THE INVENTION

Our co-pending UK Patent Application No. 0707751.4 describes vehicle armour comprising a ceramic plate with a spall covering on a front surface of the ceramic plate, the ceramic plate being bonded at a rear surface thereof to a stiff support plate, a plastically deformable layer arranged behind the support plate, and spacing means defining a front substantially planar space between the support plate and the plastically deformable layer and a rear substantially planar space arranged to be located between the plastically deformable layer and a vehicle hull.

Such a plastically deformable layer can decelerate fragments penetrating the ceramic plate and the support plate.

SUMMARY OF THE INVENTION

We have discovered that effective armour can be provided if the front substantially planar space is removed, i.e. the plastically deformable layer is contiguous with the support plate.

Accordingly, the present invention provides vehicle armour comprising a ceramic panel with a spall covering on a front surface thereof, the ceramic plate being bonded at a rear surface thereof to a stiff support plate, a plastically deformable layer arranged behind the support plate and contiguous therewith, and spacer means defining a substantially planar space arranged to be located between the plastically deformable layer and a vehicle hull.

The ceramic panel may comprise a layer of ceramic armour elements and spacing means comprising a lug on a side of a ceramic armour element arranged to co-operate with an adjacent ceramic armour element. The ceramic panel may comprise a plurality of such layers bonded together, with the ceramic armour elements of the layers being out of registration.

Whether or not the front substantially planar space is removed, the invention also provides such armour having a frontal plate comprising a ceramic layer bonded between two layers of high strength carbon or glass, a front one of which layers constitutes said spall covering. A further layer of high strength carbon or glass may be provided on the front of the ceramic panel.

In one embodiment, the support plate is of a composite material, e.g. comprising carbon or glass.

An embodiment of the invention includes a rear plastically deformable layer arranged behind said plastically deformable layer that is arranged behind the support plate.

The or each plastically deformable layer can be formed from a multiplicity of laminations. Low-density plastics such as polyethylene are suitable for forming the or each plastically deformable layer.

In embodiments of the invention, the substantially planar space(s) can contain crushable foam such as polyethylene. This helps to ensure that the movement or deformation of the ceramic plate and/or the plastically deformable area is more uniform across the entire protected area.

The invention provides armour of low areal density.

DETAILED DESCRIPTION

A particular embodiment of the invention will now be described, by way of example only, with reference to the accompanying drawings, FIG. 1 of which is a fragmentary schematic section of an armour panel according to the invention.

Figure 1:
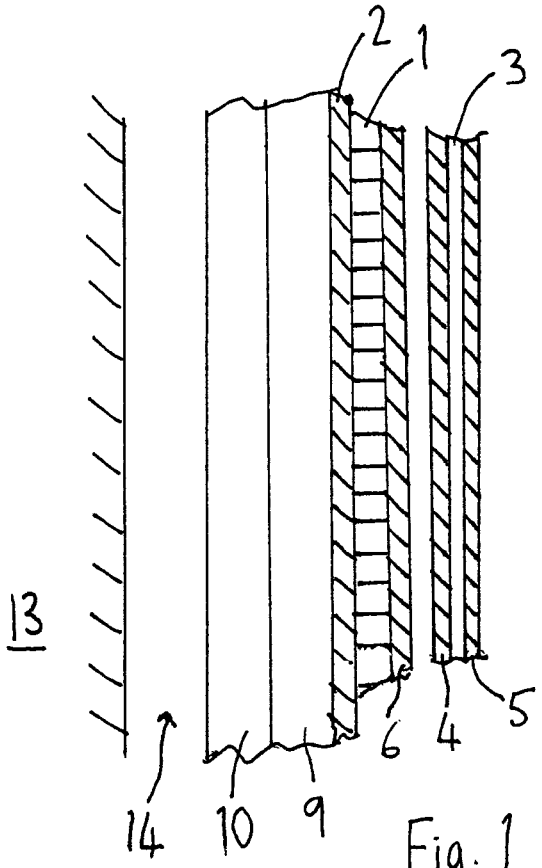
FIG. 1 is a fragmentary schematic section of an armour panel of the present invention.
Figure 2:
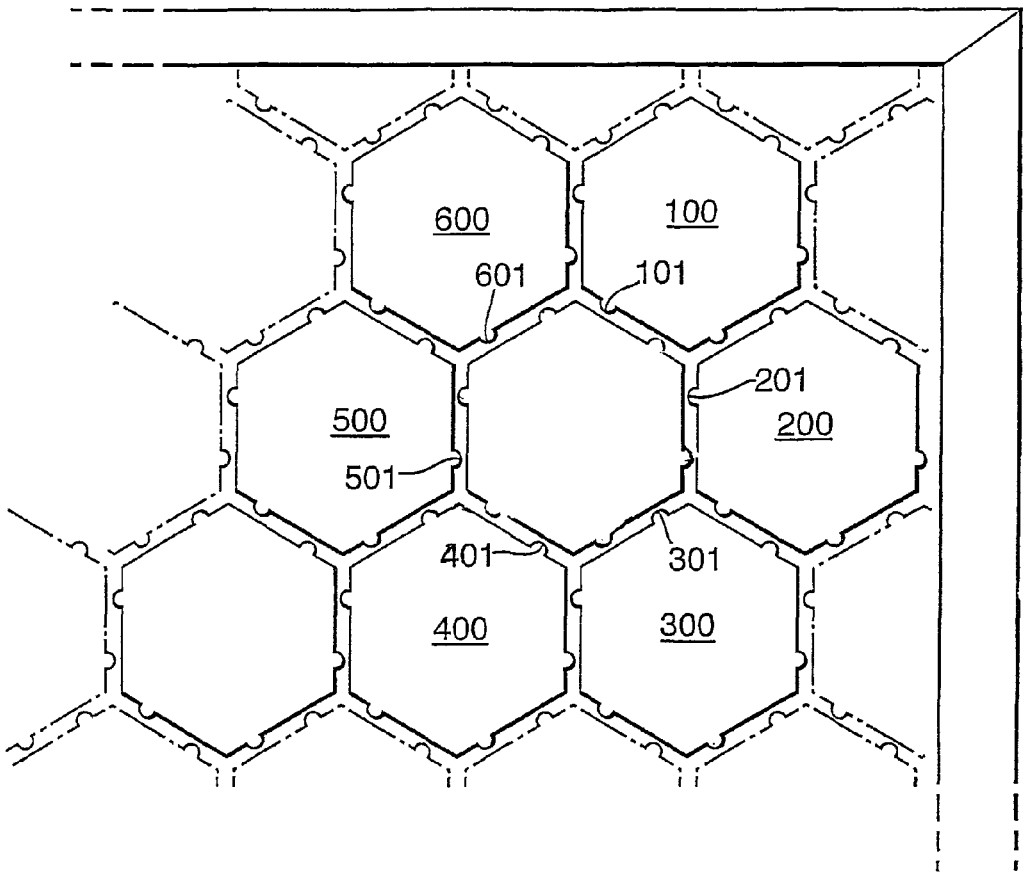
FIG. 2 is a diagram of an array of hexagonal ceramic armour elements.
Figure 3:
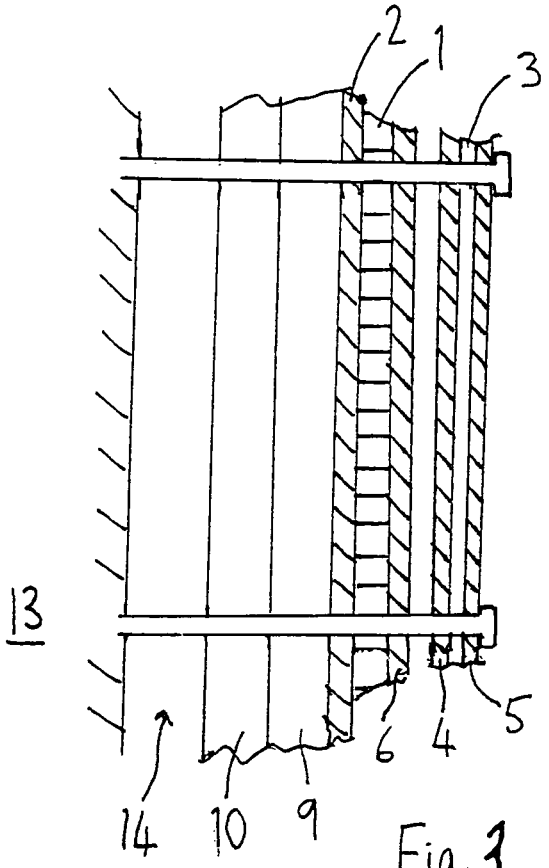
FIG. 3 is a fragmentary schematic section of an armour panel of the present invention also illustrating generic spacing rods.

FIGS. 1 and 3 show a panel comprising a ceramic layer 1 bonded to a support plate 3 of slightly greater area than the layer 1. The ceramic layer comprises ceramic armour elements and spacing means comprising a lug on a side of a ceramic armour element arranged to co-operate with an adjacent ceramic armour element (see also FIG. 2). This arrangement is described in WO 2006/103431, the entire contents of which are incorporated herein by way of reference (with numerals 100, 101, 200, 201, 300, 301, 400, 401, 500, 501, 600, and 601 of FIG. 2 being as identified therein). The panel of the invention may comprise a plurality of such layers bonded together, with the ceramic armour elements of the layers being out of registration. As an alternative to such layers, the ceramic layer(s) may be obtainable from Aceram Technologies, Inc. of Kingston, Ontario, Canada.

The ceramic layer 1 is bonded together and to the support plate 2 with an elastomeric, e.g. polyurethane-based adhesive, which may completely surround the layer 1.

In this example, the support plate 2 is of a carbon fibre/epoxy composite and has holes (not shown) adjacent each of its corners. Spacing rods e.g. aluminium tubes, extend through the holes, e.g. with a force fit, and the plate 2 is retained on the rods by spacers and nuts.

A frontal assembly comprises a ceramic layer 3, for example obtainable from The Morgan Crucible Company plc of Windsor, England, sandwiched and bonded between two layers 4, 5 of high strength carbon or glass fibre. There may be further alternate ceramic and carbon or glass layers. A further carbon or glass layer 6 is bonded to the front of the ceramic layer 1.

The spacing rods (see FIG. 3) also extend through front and rear plastically deformable plates 9, 10, which can be bonded together, the front plate 9 being assembled to the support plate 2. These may be of laminated high density polyethylene, e.g. "Dyneema"® from DSM Dyneema of Geelen, Netherlands, or another suitable polymer.

The rods maintain an air gap 14 between the rear deformable plate 10 and a vehicle hull 13. The gap 14 has a thickness allowing the deformable plates 9, 10 to deform and catch the fragments after the assembly 1 and support plate 2 have damaged them. The gap thickness could for example be from about 30 mm to about 150 mm. In this regard, a thicker gap increases protection, but there is usually a maximum vehicle width that cannot be exceeded.

The invention claimed is:

1. Vehicle armour comprising a ceramic panel with a spall covering on a front surface thereof, the spall covering comprising a first layer of carbon or glass, the ceramic panel being bonded at a rear surface thereof to a stiff support plate, a plastically deformable layer arranged behind the support plate and contiguous therewith, means for defining a substantially planar space arranged to be located between the plastically deformable layer and a vehicle hull, a second layer of carbon or glass, and a ceramic layer bonded between the first and second layers of carbon or glass.

2. Vehicle armour according to claim 1, wherein the ceramic panel comprises a layer of ceramic armour elements.

3. Vehicle armour according to claim 2, wherein the ceramic panel comprises a plurality of such layers of ceramic armour elements bonded together.

4. Vehicle armour according to claim 1, wherein the support plate is of composite material.

5. Vehicle armour according to claim 4 in which the composite material comprises carbon or glass.

6. Vehicle armour according to claim 1, including a rear plastically deformable layer arranged behind said plastically deformable layer that is arranged behind the support plate.

7. Vehicle armour according to claim 1, wherein the plastically deformable layer is formed from a multiplicity of laminations.

8. Vehicle armour according to claim 1, wherein the plastically deformable layer is formed from polyethylene.

9. Vehicle armour according to claim 8 in which the plastically deformable layer is formed from ultra-high molecular weight polyethylene.

10. Vehicle armour comprising a ceramic plate, bonded at a rear surface thereof to a stiff support plate, a plastically deformable layer arranged behind the support plate, spacing rods defining a substantially planar space arranged to be located between the plastically deformable layer and a vehicle hull, and a frontal plate on a side of the armour facing a threat and comprising a ceramic layer bonded between two layers of carbon or glass, a front one of said layers constituting a spall covering.

11. Vehicle armour according to claim 10, wherein the frontal plate comprises one or more further alternate ceramic and carbon or glass layers.

12. Vehicle armour comprising a ceramic panel with a spall covering on a front surface thereof, the ceramic panel being bonded at a rear surface thereof to a stiff support plate, a plastically deformable layer arranged behind the support plate and contiguous therewith, and means for defining a substantially planar space arranged to be located between the plastically deformable layer and a vehicle hull, wherein the substantially planar space contains crushable foam.

13. Vehicle armour according to claim 12, wherein the crushable foam comprises polyethylene.

14. Vehicle armour comprising a ceramic panel with a spall covering on a front surface thereof, the ceramic panel being bonded at a rear surface thereof to a stiff support plate, a plastically deformable layer arranged behind the support plate and contiguous therewith, and spacing rods defining a substantially planar space arranged to be located between the plastically deformable layer and a vehicle hull, and wherein the ceramic panel comprises a layer of ceramic armour elements and a spacing lug on a side of a ceramic armour element arranged to co-operate with an adjacent armour element.

15. Vehicle armour according to claim 14, wherein the ceramic panel comprises a plurality of such layers of ceramic armour elements bonded together.

16. Vehicle armour comprising a ceramic panel with a spall covering on a front surface thereof, the ceramic panel being bonded at a rear surface thereof to a stiff support plate, a plastically deformable layer arranged behind the support plate and contiguous therewith, and spacing rods defining a substantially planar space arranged to be located between the plastically deformable layer and a vehicle hull and having a frontal plate on a side of the armour facing a threat, the frontal plate comprising a ceramic layer bonded between two layers of carbon or glass, a front one of the layers constituting the spall covering.

* * * * *